US006984255B2

(12) United States Patent
Itsukaichi et al.

(10) Patent No.: US 6,984,255 B2
(45) Date of Patent: Jan. 10, 2006

(54) THERMAL SPRAYING POWDER AND METHOD OF FORMING A THERMAL SPRAYED COATING USING THE SAME

(75) Inventors: Tsuyoshi Itsukaichi, Aichi (JP); Satoru Osawa, Aichi (JP)

(73) Assignee: Fujimi Incorporated, Aichi (JP)

( * ) Notice: Subject to any disclaimer, the term of this patent is extended or adjusted under 35 U.S.C. 154(b) by 53 days.

(21) Appl. No.: 10/810,268

(22) Filed: Mar. 26, 2004

(65) Prior Publication Data

US 2004/0194662 A1 Oct. 7, 2004

(30) Foreign Application Priority Data

Mar. 31, 2003 (JP) ..... 2003-097038

(51) Int. Cl.
*B22F 1/00* (2006.01)

(52) U.S. Cl. ..... 75/252

(58) Field of Classification Search ..... 75/252
See application file for complete search history.

(56) References Cited

U.S. PATENT DOCUMENTS 3,313,633 A * 4/1967 Longo ..... 106/1.05
3,690,686 A * 9/1972 Prasse et al. ..... 277/444
4,949,836 A * 8/1990 Schostek ..... 198/676
4,961,781 A 10/1990 Morishita et al. ..... 75/244
5,063,021 A * 11/1991 Anand et al. ..... 419/12
5,292,382 A * 3/1994 Longo ..... 148/320
5,641,580 A * 6/1997 Sampath et al. ..... 428/663
6,376,103 B1 * 4/2002 Sampath et al. ..... 428/663
6,503,442 B1 * 1/2003 Fukubayashi ..... 266/270

FOREIGN PATENT DOCUMENTS

| | | |
|---|---|---|
| JP | 02015140 | 1/1990 |
| JP | 08-104969 | 4/1996 |
| JP | 09-227243 | 9/1997 |
| JP | 09-268361 | 10/1997 |

* cited by examiner

*Primary Examiner*—Ngoclan T. Mai
(74) *Attorney, Agent, or Firm*—Vidas, Arrett & Steinkraus PA

(57) ABSTRACT

The present invention relates to a thermal spraying powder capable of reliably allowing the achievement of a thermal sprayed coating having superior characteristics. A thermal spraying powder according to a first embodiment of the invention includes a predetermined amount of each of molybdenum, boron, cobalt, and chromium. The total content of molybdenum, boron, cobalt, and chromium in the thermal spraying powder is no less than 95% by weight. The primary crystal phase of the thermal spraying powder is multi-element ceramics containing at least one of cobalt and chromium along with molybdenum and boron. A thermal spraying powder according to a second embodiment of the invention includes a predetermined amount of each of molybdenum, boron, nickel, and chromium. The total content of molybdenum, boron, nickel, and chromium in this thermal spraying powder is no less than 95% by weight. The primary crystal phase of this thermal spraying powder is multi-element ceramics containing at least one of nickel and chromium along with molybdenum and boron.

18 Claims, No Drawings

THERMAL SPRAYING POWDER AND METHOD OF FORMING A THERMAL SPRAYED COATING USING THE SAME

BACKGROUND OF THE INVENTION

The present invention relates to a thermal spraying powder and a method of forming a thermal sprayed coating using such a thermal spraying powder.

Thermal sprayed coatings used for a particular purpose are required to have superior molten metal corrosion resistance, heat resistance, thermal shock resistance, oxidation resistance, and wear resistance. Such thermal sprayed coatings include thermal sprayed coatings provided on die cast molds for aluminum, and thermal sprayed coatings provided on sink rollers and support rollers used in molten zinc plating baths or molten zinc-aluminum plating baths.

Japanese Laid-Open Patent Publication Nos. 9-268361, 9-227243, and 8-104969 propose powders for thermal spraying capable of forming a thermal sprayed coating having improved thermal shock resistance, oxidation resistance, and wear resistance.

Japanese Laid-Open Patent Publication No. 9-268361 discloses a thermal spraying powder containing a predetermined amount of each of molybdenum, boron, cobalt, chromium, and tungsten. Japanese Laid-Open Patent Publication No. 9-227243 discloses a thermal spraying powder containing a predetermined amount of each of molybdenum boride, nickel, chromium, and a predetermined metal boride, along with a thermal spraying powder containing a predetermined amount of each of molybdenum boride, cobalt, chromium, and a predetermined metal boride. Japanese Laid-Open Patent Publication No. 8-104969 discloses a thermal spraying powder composed of a compound boride of nickel and molybdenum and nickel, along with a thermal spraying powder composed of a compound boride of cobalt and molybdenum and cobalt.

However, the thermal sprayed coatings formed by using the thermal spraying powders disclosed in Japanese Laid-Open Patent Publications Nos. 9-268361 and 9-227243 do not demonstrate very high levels of molten metal corrosion resistance, heat resistance, thermal shock resistance, oxidation resistance, and wear resistance. In addition, thermal sprayed coatings having superior molten metal corrosion resistance, heat resistance, thermal shock resistance, oxidation resistance, and wear resistance cannot be reliably obtained even if the thermal spraying powder disclosed in Japanese Laid-Open Patent Publication No. 8-104969 is used.

SUMMARY OF THE INVENTION

Accordingly, it is an objective of the present invention to provide a thermal spraying powder capable of reliably allowing the achievement of a thermal sprayed coating having superior molten metal corrosion resistance, heat resistance, thermal shock resistance, oxidation resistance, and wear resistance, and to provide a method of forming a thermal sprayed coating using such a thermal spraying powder.

To achieve the above objective, the present invention provides a thermal spraying powder. The thermal spraying powder contains no less than 30% by weight and no more than 70% by weight of molybdenum, no less than 5% by weight and no more than 12% by weight of boron, no less than 10% by weight and no more than 40% by weight of cobalt, and no less than 15% by weight and no more than 25% by weight of chromium. The total content of molybdenum, boron, cobalt, and chromium in the thermal spraying powder is no less than 95% by weight. The primary crystal phase of the thermal spraying powder is multi-element ceramics containing at least one of cobalt and chromium along with molybdenum and boron.

The present invention provides another thermal spraying powder. The thermal spraying powder contains no less than 30% by weight and no more than 70% by weight of molybdenum, no less than 5% by weight and no more than 12% by weight of boron, no less than 15% by weight and no more than 45% by weight of nickel, and no less than 12% by weight and no more than 25% by weight of chromium. The total content of molybdenum, boron, nickel, and chromium in the thermal spraying powder is no less than 95% by weight. The primary crystal phase of the thermal spraying powder is multi-element ceramics containing at least one of nickel and chromium along with molybdenum and boron.

In another aspect of the present invention, a method of forming a thermal sprayed coating is provided. The method includes preparing a thermal spraying powder containing no less than 30% by weight and no more than 70% by weight of molybdenum, no less than 5% by weight and no more than 12% by weight of boron, no less than 10% by weight and no more than 40% by weight of cobalt, and no less than 15% by weight and no more than 25% by weight of chromium, wherein the total content of molybdenum, boron, cobalt, and chromium in the thermal spraying powder is no less than 95% by weight, and the primary crystal phase of the thermal spraying powder is multi-element ceramics containing at least one of cobalt and chromium along with molybdenum and boron; thermally spraying the thermal spraying powder onto a substrate to form a thermal sprayed coating on the surface of the substrate; coating a sealing treatment agent onto the thermal sprayed coating formed on the surface of the substrate, the sealing treatment agent containing boron nitride and an organic silicon polymer in which the carbosilane bonds and siloxane bonds remain when ceramic conversion has been carried out; and carrying out ceramic conversion on the sealing treatment agent by thermal decomposition of the sealing treatment agent coated onto the thermal sprayed coating.

The present invention provides another method of forming a thermal sprayed coating. The method includes preparing a thermal spraying powder containing no less than 30% by weight and no more than 70% by weight of molybdenum, no less than 5% by weight and no more than 12% by weight of boron, no less than 15% by weight and no more than 45% by weight of nickel, and no less than 12% by weight and no more than 25% by weight of chromium, wherein the total content of molybdenum, boron, nickel, and chromium in the thermal spraying powder is no less than 95% by weight, and the primary crystal phase of the thermal spraying powder is multi-element ceramics containing at least one of nickel and chromium along with molybdenum and boron; thermally spraying the thermal spraying powder onto a substrate to form a thermal sprayed coating on the surface of the substrate; coating a sealing treatment agent onto the thermal sprayed coating formed on the surface of the substrate, the sealing treatment agent containing boron nitride and an organic silicon polymer in which the carbosilane bonds and siloxane bonds remain when ceramic conversion has been carried out; and carrying out ceramic conversion on the sealing treatment agent by thermal decomposition of the sealing treatment agent coated onto the thermal sprayed coating.

Other aspects and advantages of the invention will become apparent from the following description, illustrating by way of example the principles of the invention.

DETAILED DESCRIPTION OF THE PREFERRED EMBODIMENTS

A first embodiment of the present invention will now be described.

A thermal spraying powder according to a first embodiment contains molybdenum, boron, cobalt, and chromium.

The content of molybdenum in the thermal spraying powder is no less than 30% by weight, preferably no less than 35% by weight, and more preferably no less than 40% by weight, but no more than 70% by weight, preferably no more than 60% by weight, and more preferably no more than 50% by weight. If the content of molybdenum is too low, the molten metal corrosion resistance, heat resistance, oxidation resistance, and wear resistance of the thermal sprayed coating decrease considerably. If the content of molybdenum is too high, the toughness and adhesion of the thermal sprayed coating decrease considerably. As the toughness and adhesion of the thermal sprayed coating decrease, the thermal shock resistance of the thermal sprayed coating also decreases.

The content of boron in the thermal spraying powder is no less than 5% by weight and preferably no less than 6% by weight, but no more than 12% by weight and preferably no more than 10% by weight. If the content of boron is too low, the molten metal corrosion resistance, heat resistance, oxidation resistance, and wear resistance of the thermal sprayed coating decrease considerably. If the content of boron is too high, the toughness and adhesion of the thermal sprayed coating decrease considerably.

The content of cobalt in the thermal spraying powder is no less than 10% by weight, preferably no less than 15% by weight, and more preferably no less than 20% by weight, but no more than 40% by weight and preferably no more than 35% by weight. If the content of cobalt is too low, the toughness and adhesion of the thermal sprayed coating decrease considerably. If the content of cobalt is too high, the molten metal corrosion resistance, heat resistance, oxidation resistance, and wear resistance of the thermal sprayed coating decrease considerably.

The content of chromium in the thermal spraying powder is no less than 15% by weight, preferably no less than 16% by weight, and more preferably no less than 17% by weight, but no more than 25% by weight, preferably no more than 22% by weight, and more preferably no more than 20% by weight. If the content of chromium is too low, the molten metal corrosion resistance, heat resistance, oxidation resistance, and wear resistance of the thermal sprayed coating decrease considerably. If the content of chromium is too high, the toughness and adhesion of the thermal sprayed coating decrease considerably.

The total content of molybdenum, boron, cobalt, and chromium in the thermal spraying powder is no less than 95% by weight. In other words, in the case where a thermal spraying powder contains components other than molybdenum, boron, cobalt, and chromium, the content of those other components in the thermal spraying powder is less than 5% by weight. In the case where a thermal spraying powder contains tungsten as the other component, the content of tungsten in the thermal spraying powder is preferably no more than 4% by weight. If the content of tungsten is too high, the molten metal corrosion resistance, heat resistance, thermal shock resistance, oxidation resistance, and wear resistance of the thermal sprayed coating decrease considerably. In the case where a thermal spraying powder contains carbon as the other component, the content of carbon in the thermal spraying powder is preferably no more than 1% by weight. If the content of carbon is too high, the thermal shock resistance of the thermal sprayed coating decreases considerably.

The primary crystal phase of the thermal spraying powder is multi-element ceramics containing at least one of cobalt and chromium along with molybdenum and boron. This means that the first peak originating in the aforementioned multi-element ceramics in an X-ray diffraction pattern of the thermal spraying powder has an intensity of no less than twice that of any of the other first peaks. The first peak originating in the aforementioned multi-element ceramics preferably has an intensity that is no less than three times that of any of the other first peaks. In the case where the primary crystal phase of the thermal spraying powder is not the aforementioned multi-element ceramics, the molten metal corrosion resistance, heat resistance, thermal shock resistance, oxidation resistance, and wear resistance of the thermal sprayed coating decrease considerably. It should be noted that the first peak refers to the peak among those peaks originating in the same chemical species that has the greatest intensity.

The particles that compose the thermal spraying powder preferably have mechanical strength of no less than 50 MPa, more preferably no less than 100 MPa, and most preferably no less than 150 MPa, while having mechanical strength of preferably no more than 600 MPa, more preferably no more than 500 MPa, and most preferably no more than 400 MPa. If the mechanical strength is too large, it becomes difficult to melt the thermal spraying powder during thermal spraying, thereby making it difficult to form a thermal sprayed coating. If the mechanical strength is too small, spitting occurs easily during thermal spraying. Spitting refers to a phenomenon in which molten thermal spraying powder adheres and accumulates on the inside walls of the injection nozzles of the thermal sprayer, which causes contamination of the thermal sprayed coating due to those deposits falling off during thermal spraying. Spitting causes a decrease in the quality of thermal sprayed coatings.

The mechanical strength of the particles that compose thermal spraying powders is calculated according to the following calculation formula 1. In the case of subjecting the particles to a compressive load that increases at a fixed rate relative to time with an indenter, the displacement of the indenter increases suddenly when breakage has occurred in the particles The "breaking load" in calculation formula 1 is the value of the compressive load when a sudden increase has occurred in the displacement of the indenter. The breaking load is measured using, for example, a "Micro Compression Tester," model no. MCTE-500 manufactured by Shimadzu Corporation.

$$\text{Particle mechanical strength} = 2.8 \times \text{breaking load} / \pi / \text{particle size}^2. \qquad \text{Calculation Formulation 1:}$$

The particle size distribution of the thermal spraying powder is preferably suitably set according to the type of thermal sprayer and thermal spraying conditions used during thermal spraying, and is set to, for example, 5–75 μm, 10–45 μm, 15–45 μm, 20–63 μm, 25–75 μm, or 45–250 μm. The lower limit value of particle size distribution is the value at which the ratio of particles contained in the powder that have a particle size equal to or lower than that value is no more than 5%, and is measured using, for example, a laser diffraction type of particle size measuring instrument (such as the "LA-300" manufactured by Horiba Ltd.). The upper limit value of particle size distribution is the value at which the ratio of particles contained in the powder that have a particle size equal to or greater than that value is no more than 5%, and is measured according to, for example, the sieve analysis method defined in JIS R6002. Namely, powder having a particle size distribution of 5–75 μm contains no more than 5%. of particles having a particle size of no more than 5 μm and no more than 5% of particles having a particle size of no less than 75 μm.

A thermal spraying powder according to the first embodiment is produced by a granulation sintering method. In a granulation sintering method, a slurry is first prepared by mixing a plurality of raw material powders and a suitable dispersion medium. This slurry is then granulated by spraying granulation, and a sintered compact is then formed by sintering the granulated powder. The thermal spraying powder is then obtained by crushing and classifying the resulting sintered compact. The sintering temperature during sintering of the granulated powder is preferably 1000 to 1200° C. inclusive.

Molybdenum, boron, cobalt, and chromium are respectively contained in any of the aforementioned plurality of raw material powders. Specific examples of raw material powders include monomolybdenum boride powder, dimolybdenum boride powder, chromium monoboride powder, chromium diboride powder, tungsten carbide powder, chromium carbide powder, monomolybdenum carbide powder, dimolybdenum carbide powder, cobalt powder, cobalt alloy powder, chromium powder, chromium alloy powder, molybdenum powder, molybdenum alloy powder, tungsten powder, tungsten alloy powder, and carbon powder. Since the aforementioned multi-element ceramics can be formed during the thermal spraying powder production process, and more specifically, during sintering of the granulated powder, the raw material powders are not required to be the aforementioned multi-element ceramics.

The average particle size of each raw material powder is preferably no less than 0.1 μm and more preferably no less than 0.5 μm, but preferably no more than 10 μm, and preferably no more than 5 μm. In the case where a raw material powder is composed of ceramics or pure metal, the average particle size of the raw material powder is measured according to the Fischer sub-sieve sizer (FSSS) method, and in the case where a raw material powder is composed of an alloy, the average particle size of the raw material powder is measured using a laser diffraction type of particle size measuring instrument (e.g., "LA-300" manufactured by Horiba, Ltd.). If the average particle size of a raw material powder is too small, costs increase. If the average particle size of a raw material powder is too large, it becomes difficult to uniformly disperse the raw material powder, which may prevent the main crystal phase of the thermal spraying powder from becoming multi-element ceramics.

The method of forming a thermal sprayed coating according to the first embodiment is provided with a step in which a thermal spraying powder as described above is prepared, a coating formation step in which a thermal sprayed coating is formed on the surface of a substrate, a coating step in which a sealing treatment agent is coated onto the thermal sprayed coating, and a heating step in which ceramic conversion is carried out by thermal decomposition of the sealing treatment agent.

In the coating formation step, the thermal spraying powder according to the first embodiment is thermally sprayed onto the surface of a substrate, and as a result, a thermal sprayed coating is formed on the surface of the substrate. Plasma thermal spraying or high-velocity flame spraying is preferable for the method of thermally spraying the thermal spraying powder, and high-velocity flame spraying is particularly preferable. A plasma sprayer containing a plasma transfer arc (PTA) device or a high-velocity flame sprayer is preferable as the sprayer for thermally spraying the thermal spraying powder, and a high-velocity flame sprayer is particularly preferable. Preferable examples of high-velocity flame sprayers include the "θ-Gun" manufactured by Whitco Japan Ltd., and the "JP-5000" manufactured by PRAXAIR/TAFA.

In the coating step, a sealing treatment agent is coated onto the thermal sprayed coating formed on the surface of the substrate in the aforementioned coating formation step. The sealing treatment agent is an agent containing boron nitride and an organic silicon polymer in which the carbosilane bonds (—(Si—C)—) and siloxane bonds (—(Si—O)—) remain when ceramic conversion is carried out, an example of which is "MR-100" manufactured by Okitsumo Incorporated. The sealing treatment agent is applied by, for example, dipping, brush coating, or spraying.

In the heating step, the sealing treatment agent coated onto the thermal sprayed coating is thermally decomposed so as to convert the sealing heating agent to ceramics. The heating temperature during thermal decomposition of the sealing treatment agent is at least a temperature that is adequate for ceramic conversion of the sealing treatment agent.

The thermal sprayed coating formed by the thermal sprayed coating forming method according to the present embodiment has particularly superior molten metal corrosion resistance, heat resistance, thermal shock resistance, oxidation resistance, and wear resistance.

A second embodiment of the present invention will now be described.

A thermal spraying powder according to a second embodiment contains molybdenum, boron, nickel, and chromium.

The content of molybdenum in the thermal spraying powder according to the second embodiment is no less than 30% by weight, preferably no less than 35% by weight, and more preferably no less than 40% by weight, but no more than 70% by weight, preferably no more than 60% by weight, and more preferably no more than 50% by weight.

The content of boron in the thermal spraying powder according to the second embodiment is no less than 5% by weight and preferably no less than 6% by weight, but no more than 12% by weight and preferably no more than 10% by weight.

The content of nickel in the thermal spraying powder according to the second embodiment is no less than 15% by weight, preferably no less than 20% by weight, and more preferably no less than 25% by weight, but no more than 45% by weight, preferably no more than 40% by weight, and more preferably no more than 35% by weight. If the content of nickel is too low, the toughness and adhesion of the thermal sprayed coating decrease considerably. If the content of nickel is too high, molten metal corrosion resistance, heat resistance, oxidation resistance, and wear resistance decrease considerably.

The content of chromium in the thermal spraying powder according to the second embodiment is no less than 12% by weight, preferably no less than 13% by weight, and more preferably no less than 14% by weight, but no more than 25% by weight, preferably no more than 20% by weight, and more preferably no more than 18% by weight.

The total content of molybdenum, boron, nickel, and chromium in the thermal spraying powder according to the second embodiment is no less than 95% by weight. In other words, in the case where a thermal spraying powder according to the second embodiment contains components other than molybdenum, boron, nickel, and chromium, the content of those other components in the thermal spraying powder is less than 5% by weight. In the case where a thermal spraying powder according to the second embodiment contains tungsten as the other component, the content of tungsten in the thermal spraying powder is preferably no more than 4% by weight. In the case where a thermal spraying powder according to the second embodiment contains carbon as the other component, the content of carbon in the thermal spraying powder is preferably no more than 1% by weight.

The primary crystal phase of the thermal spraying powder according to the second embodiment is multi-element ceramics containing at least one of nickel and chromium along with molybdenum and boron. This means that the first peak originating in the aforementioned multi-element ceramics in an X-ray diffraction pattern of the thermal spraying powder according to the second embodiment has an intensity of no less than twice that of any of the other first peaks. The first peak originating in the aforementioned multi-element ceramics preferably has an intensity that is no less than three times that of any of the other first peaks. In the case where the primary crystal phase of the thermal spraying powder according to the second embodiment is not the aforementioned multi-element ceramics, the molten metal corrosion resistance, heat resistance, thermal shock resistance, oxidation resistance, and wear resistance of the thermal sprayed coating decrease considerably.

The particles that compose the thermal spraying powder according to the second embodiment preferably have mechanical strength of no less than 50 MPa, more preferably no less than 100 MPa, and most preferably no less than 150 MPa, while having mechanical strength of preferably no more than 600 MPa, more preferably no more than 500 MPa, and most preferably no more than 400 MPa.

The particle size distribution of the thermal spraying powder according to the second embodiment is preferably suitably set according to the type of thermal sprayer and thermal spraying conditions used during thermal spraying.

Similar to the thermal spraying powder according to the first embodiment, a thermal spraying powder according to the second embodiment is produced by the granulation sintering method. Molybdenum, boron, nickel, and chromium are respectively contained in any of the plurality of raw material powders. Specific examples of raw material powders include monomolybdenum boride powder, dimolybdenum boride powder, chromium monoboride powder, chromium diboride powder, tungsten carbide powder, chromium carbide powder, monomolybdenum carbide powder, dimolybdenum carbide powder, nickel powder, nickel alloy powder, chromium powder, chromium alloy powder, molybdenum powder, molybdenum alloy powder, tungsten powder, tungsten alloy powder, and carbon powder.

The average particle size in each raw material powder is preferably no less than 0.1 $\mu$m and more preferably no less than 0.5 $\mu$m, but preferably no more than 10 $\mu$m, and preferably no more than 5 $\mu$m.

The method of forming a thermal sprayed coating according to the second embodiment is the same as the method of forming a thermal sprayed coating according to the first embodiment with the exception of using a thermal spraying powder according to the second embodiment instead of a thermal spraying powder according to the first embodiment.

A thermal sprayed coating formed by the thermal spraying coating forming method according to the second embodiment also has particularly superior molten metal corrosion resistance, heat resistance, thermal shock resistance, oxidation resistance, and wear resistance.

It should be apparent to those skilled in the art that the present invention may be embodied in many other specific forms without departing from the spirit of scope of the invention. Particularly, it should be understood that the invention may be embodied in the following forms.

The thermal spraying powders according to the first and second embodiments may be produced by a sintering crushing method instead of a granulation sintering method. In the sintering crushing method, a molded compact is first formed by mixing a plurality of raw material powders followed by compression molding, after which the molded compact is sintered to form a sintered compact. The thermal spraying powder is then obtained by crushing and classifying the resulting sintered compact.

The thermal spraying powders according to the first and second embodiments may also be produced by a melt crushing method instead of a granulation sintering method. In the melt crushing method, an ingot is first formed by mixing a plurality of raw material powders followed by melting by heating and then cooling. The thermal spraying powder is then obtained by crushing and classifying the resulting ingot.

The following provides a more detailed explanation of the present invention through its examples and comparative examples.

EXAMPLES 1–11 AND COMPARATIVE EXAMPLES 1 AND 2

In Examples 1 to 11 and Comparative Examples 1 and 2, thermal spraying powders were produced by the granulation sintering method using raw material powders consisting of molybdenum boride power having an average particle size of 4.5 $\mu$m, cobalt alloy powder (Stelite #6) having an average particle size of 7 $\mu$m, and chromium diboride powder having an average particle size of 4.5 $\mu$m.

EXAMPLE 12

In Example 12, a thermal spraying powder was produced by the granulation sintering method using raw material powders consisting of molybdenum boride powder having an average particle size of 4.5 $\mu$m, cobalt alloy (Stelite #6) powder having an average particle size of 7 $\mu$m, and chromium monoboride powder having an average particle size of 4.7 $\mu$m.

EXAMPLES 21–31 AND COMPARATIVE EXAMPLES 3 AND 4

In Examples 21 to 31 and Comparative Examples 3 and 4, thermal spraying powders were produced by the granulation sintering method using raw material powders consisting of molybdenum boride powder having an average particle size of 4.5 $\mu$m, nickel chromium alloy powder having an average particle size of 7 $\mu$m, and chromium diboride powder having an average particle size of 4.5 $\mu$m.

EXAMPLE 32

In Example 32, a thermal spraying powder was produced by the granulation sintering method using raw material powders consisting of molybdenum boride powder having an average particle size of 4.5 μm, nickel chromium alloy powder having an average particle size of 7 μm, and chromium monoboride powder having an average particle size of 4.7 μm.

Comparative Example 5

In Comparative Example 5, a thermal spraying powder was produced by the granulation sintering method using raw material powders consisting of molybdenum boride powder having an average particle size of 4.5 μm, cobalt powder having an average particle size of 1.2 μm, chromium powder having an average particle size of 3.0 μm, and tungsten powder having an average particle size of 1.5 μm.

Comparative Example 6

In Comparative Example 6, a thermal spraying powder was produced by the granulation sintering method using raw material powders consisting of molybdenum boride powder having an average particle size of 4.5 μm, cobalt powder having an average particle size of 1.2 μm, and molybdenum powder having an average particle size of 1.5 μm.

Comparative Example 7

In Comparative Example 7, a thermal spraying powder was produced by the granulation sintering method using raw material powders consisting of molybdenum boride powder having an average particle size of 4.5 μm, tungsten boride powder having an average particle size of 2.5 μm, molybdenum powder having an average particle size of 1.5 μm, and nickel powder having an average particle size of 3.0 μm.

Comparative Example 8

In Comparative Example 8, a thermal spraying powder was produced by the granulation sintering method using raw material powders consisting of molybdenum boride powder having an average particle size of 4.5 μm, chromium diboride powder having an average particle size of 4.5 μm, nickel powder having an average particle size of 3.0 μm, and chromium powder having an average particle size of 3.0 μm.

A thermal sprayed coating having a thickness of 200 μm was formed on a portion extending to 100 mm from the end of a rod formed with alloy tool steel (SKD-61) using each of the aforementioned thermal spraying powders of Examples 1 to 12 and 21 to 32 and Comparative Examples 1 to 8. The rod measured 19 mm in diameter and 200 mm in length, and the end of the rod had a radius of curvature of 10 mm. During formation of the thermal sprayed coating, the "JP-5000" manufactured by PRAXAIR/TAFA was used as the thermal sprayer, and thermal spraying was carried out at an oxygen flow rate of 893 L/min, kerosene flow rate of 0.32 L/min, spraying distance of 380 mm, and a thermal spraying powder feed rate of 50 g/min.

The rods on which the thermal sprayed coatings were formed were dipped for 30 seconds in a 10% by weight solution of "MR-100" manufactured by Okitsumo Incorporated, followed by applying a 10% by weight solution of "MR-100" onto the thermal sprayed coating on the surface of the rod using a brush. Dipping and brush coating were alternately repeated three times each. After allowing the rods coated with "MR-100" to dry in a shaded area for 12 hours, they were heated at 180° C. for 3 hours and then at 300° C. for 3 hours.

The rods coated with "MR-100" were used in a metal melt test. In the metal melt test, after immersing the rods in an aluminum melt at 750° C. for 7.5 hours, the rods were lifted out of the melt and air-cooled for 1 minute. This procedure was repeated until melting damage occurred in the thermal sprayed coating on the rod surface. While immersed in the melt, the rod material was rotated at 120 rpm and revolved at 30 rpm. In the case where the amount of time required until the occurrence of melting damage was less than 25 hours, the thermal sprayed coating was evaluated with a symbol X, if the required time was 25 to less than 50 hours, it was evaluated with a symbol ▲, if the required time was 50 to less than 100 hours, it was evaluated with a symbol Δ, if the required time was 100 to less than 200 hours, it was evaluated with a symbol ○, and if the required time was 200 hours or longer, it was evaluated with a symbol ◎. The evaluation results are shown in the "Durability" columns of Tables 1 through 3. Superior durability indicates superior corrosion resistance, heat resistance, thermal shock resistance, oxidation resistance, and wear resistance with respect to an aluminum melt at 750° C. Inferior durability indicates inferior corrosion resistance, heat resistance, thermal shock resistance, oxidation resistance, or wear resistance with respect to the aluminum melt.

TABLE 1

| | Chemical components of thermal spraying powder (wt %) | | | | | | Mechanical | | Adhesion | | |
|---|---|---|---|---|---|---|---|---|---|---|---|
| | Mo | Co | B | Cr | W | C | strength (Mpa) | Peak ratio | Spitting | efficiency | Durability |
| Ex. 1 | Remainder | 26.0 | 8.5 | 18.2 | 2.0 | 0.4 | 250 | 5.2 | ◎ | ◎ | ◎ |
| Ex. 2 | Remainder | 26.0 | 8.5 | 18.2 | 2.0 | 0.4 | 120 | 5.0 | ◎ | ○ | ◎ |
| Ex. 3 | Remainder | 26.0 | 8.5 | 18.2 | 2.0 | 0.4 | 70 | 4.8 | ○ | ○ | ◎ |
| Ex. 4 | Remainder | 26.0 | 8.5 | 18.2 | 2.0 | 0.4 | 40 | 4.2 | Δ | Δ | ◎ |
| Ex. 5 | Remainder | 26.0 | 8.5 | 18.2 | 2.0 | 0.4 | 450 | 5.2 | ◎ | ○ | ◎ |
| Ex. 6 | Remainder | 26.0 | 8.5 | 18.2 | 2.0 | 0.4 | 560 | 5.4 | ◎ | Δ | ◎ |
| Ex. 7 | Remainder | 26.0 | 8.5 | 18.2 | 2.0 | 0.4 | 680 | 5.6 | ◎ | Δ | ◎ |
| Ex. 8 | Remainder | 26.0 | 8.0 | 16.8 | 2.0 | 0.4 | 260 | 5.2 | ◎ | ◎ | ○ |
| Ex. 9 | Remainder | 26.0 | 7.5 | 15.5 | 2.0 | 0.4 | 240 | 5.3 | ◎ | ◎ | Δ |
| Ex. 10 | Remainder | 26.0 | 9.5 | 20.8 | 2.0 | 0.4 | 260 | 5.2 | ◎ | ◎ | ○ |
| Ex. 11 | Remainder | 26.0 | 10.5 | 23.4 | 2.0 | 0.4 | 250 | 5.1 | ◎ | ◎ | Δ |
| Ex. 12 | Remainder | 26.0 | 6.8 | 19.9 | 2.0 | 0.4 | 250 | 5.3 | ◎ | ◎ | ◎ |
| C. Ex. 1 | Remainder | 26.0 | 6.6 | 14.2 | 2.0 | 0.4 | 240 | 5.3 | ◎ | ◎ | X |
| C. Ex. 2 | Remainder | 26.0 | 11.4 | 26.0 | 2.0 | 0.4 | 250 | 5.4 | ◎ | ◎ | X |

TABLE 2

| | Chemical components of thermal spraying powder (wt %) | | | | Mechanical | | Adhesion | | |
|---|---|---|---|---|---|---|---|---|---|
| | Mo | Ni | B | Cr | strength (Mpa) | Peak ratio | Spitting | efficiency | Durability |
| Ex. 21 | Remainder | 32.0 | 8.5 | 14.6 | 250 | 5.5 | ◎ | ◎ | ○ |
| Ex. 22 | Remainder | 32.0 | 8.5 | 14.6 | 120 | 5.3 | ◎ | ○ | ○ |
| Ex. 23 | Remainder | 32.0 | 8.5 | 14.6 | 70 | 5.2 | ○ | ○ | ○ |
| Ex. 24 | Remainder | 32.0 | 8.5 | 14.6 | 40 | 4.3 | Δ | Δ | ○ |
| Ex. 25 | Remainder | 32.0 | 8.5 | 14.6 | 450 | 5.6 | ◎ | ○ | ○ |
| Ex. 26 | Remainder | 32.0 | 8.5 | 14.6 | 560 | 5.4 | ◎ | Δ | ○ |
| Ex. 27 | Remainder | 32.0 | 8.5 | 14.6 | 680 | 5.7 | ◎ | Δ | ○ |
| Ex. 28 | Remainder | 32.0 | 8.0 | 13.2 | 260 | 5.5 | ◎ | ◎ | Δ |
| Ex. 29 | Remainder | 32.0 | 7.8 | 12.6 | 240 | 5.6 | ◎ | ◎ | ▲ |
| Ex. 30 | Remainder | 32.0 | 10.0 | 18.5 | 260 | 5.5 | ◎ | ◎ | Δ |
| Ex. 31 | Remainder | 32.0 | 10.9 | 21.1 | 250 | 5.4 | ◎ | ◎ | ▲ |
| Ex. 32 | Remainder | 32.0 | 6.8 | 16.3 | 250 | 5.6 | ◎ | ◎ | ○ |
| C. Ex. 3 | Remainder | 32.0 | 7.3 | 11.3 | 240 | 5.4 | ◎ | ◎ | X |
| C. Ex. 4 | Remainder | 32.0 | 12.4 | 25.1 | 250 | 5.6 | ◎ | ◎ | X |

TABLE 3

| | Chemical components of thermal spraying powder (wt %) | | | | | | Mechanical | | Adhesion | | |
|---|---|---|---|---|---|---|---|---|---|---|---|
| | Mo | Co | Ni | B | Cr | W | strength (Mpa) | Peak ratio | Spitting | efficiency | Durability |
| C. Ex. 5 | Remainder | 18.0 | — | 7.1 | 8.0 | 4.0 | 240 | 4.8 | ◎ | Δ | X |
| C. Ex. 6 | Remainder | 45.0 | — | 5.5 | — | — | 260 | 5.3 | ◎ | Δ | X |
| C. Ex. 7 | Remainder | — | 35.0 | 5.4 | — | 8.5 | 270 | 5.2 | ◎ | Δ | X |
| C. Ex. 8 | Remainder | — | 30.0 | 7.4 | 14.6 | — | 40 | 0 | X | Δ | X |

"Mechanical strength" in Tables 1 to 3 indicates the mechanical strength of particles that compose the thermal spraying powder.

"Peak ratio" in Tables 1 to 3 indicates the ratio P1/P2 of the intensity of the first peak P1 originating in multi-element ceramics in an X-ray diffraction pattern of the thermal spraying powder to the intensity of the peak P2 that is the maximum peak among the other first peaks. The "RINT2000" manufactured by Rigaku Corporation was used for measuring X-ray diffraction patterns. Measurements were carried out over a range of 2θ of 10 to 70 degrees using CuKα rays for the X-ray source.

"Adhesion efficiency" in Tables 1 to 3 indicates the adhesion efficiency of the thermal spraying powder. An adhesion efficiency of 45% or more as calculated according to the following calculation formula 2 was evaluated with a symbol ◎, adhesion efficiency of 35% to less than 45% was evaluated with a symbol ○, and adhesion efficiency of less than 35% was evaluated with a symbol Δ.

Adhesion efficiency (%)={(weight of substrate after thermal spraying−weight of substrate before thermal spraying)/weight of thermal spraying powder used for thermal spraying}×100. Calculation Formula 2

"Spitting" in Tables 1 to 3 represents the degree of adherence of thermal spraying powder occurring on the inside walls of the injection nozzles of the thermal sprayer when continuously thermal spraying for 10 minutes or 30 minutes using the "JP-5000" manufactured by PRAXAIR/TAFA as the thermal sprayer. The absence of adherence of thermal spraying powder even after continuously thermal spraying for 30 minutes was evaluated with a symbol ◎, the absence of adherence after continuously thermal spraying for 10 minutes was evaluated with a symbol ○, and the presence of adherence after continuously thermal spraying for 10 minutes was evaluated with a symbol Δ.

Comparative Example 9

In Comparative Example 9, an undercoating layer was first formed on the surface of the aforementioned rod by plasma thermal spraying of a cobalt alloy onto the rod. Next, a thermal sprayed coating was formed by plasma thermal spraying of the thermal spraying powder of Comparative Example 8 onto the undercoating layer. A top coating was then formed by plasma thermal spraying of alumina-zirconia onto that thermal sprayed coating. When the rod provided with an undercoating layer, thermal sprayed coating, and top coating layer was subjected to a metal melt test, melting damage occurred within 25 hours after the start of testing.

The present examples and embodiments are to be considered as illustrative and not restrictive and the invention is not to be limited to the details given herein, but may be modified within the scope and equivalence of the appended claims.

What is claimed is:

1. A thermal spraying powder comprising:

no less than 30% by weight and no more than 70% by weight of molybdenum;

no less than 5% by weight and no more than 12% by weight of boron;

no less than 10% by weight and no more than 40% by weight of cobalt; and no less than 15% by weight and no more than 25% by weight of chromium, wherein, the total content of molybdenum, boron, cobalt, and chromium in the thermal spraying powder is no less than 95% by weight; and, the primary crystal phase of the thermal spraying powder is multi-element ceramics containing at least one of cobalt and chromium along with molybdenum and boron.

2. The thermal spraying powder according to claim 1, wherein in an X-ray diffraction pattern of the thermal spraying powder, there is a plurality of peaks originating from the multi-element ceramics with one of the peaks having a maximum intensity that is no less than twice that of other peaks originating in chemical species other than the multi-element ceramics.

3. The thermal spraying powder according to claim 1, wherein the content of molybdenum in the thermal spraying powder is no less than 40% by weight and no more than 50% by weight.

4. The thermal spraying powder according to claim 1, wherein the content of boron in the thermal spraying powder is no less than 6% by weight and no more than 10% by weight.

5. The thermal spraying powder according to claim 1, wherein the content of cobalt in the thermal spraying powder is no less than 20% by weight and no more than 35% by weight.

6. The thermal spraying powder according to claim 1, wherein the content of chromium in the thermal spraying powder is no less than 17% by weight and no more than 20% by weight.

7. The thermal spraying powder according to claim 1, wherein the thermal spraying powder is composed of particles, and the particles have mechanical strength of no less than 50 MPa and no more than 600 MPa.

8. The thermal spraying powder according to claim 7, wherein the particles have mechanical strength of no less than 150 MPa and no more than 400 MPa.

9. The thermal spraying powder according to claim 1, wherein the thermal spraying powder is used in applications for forming a thermal sprayed coating by high-velocity flame spraying.

10. A thermal spraying powder comprising:

no less than 30% by weight and no more than 70% by weight of molybdenum;

no less than 5% by weight and no more than 12% by weight of boron;

no less than 15% by weight and no more than 45% by weight of nickel; and no less than 12% by weight and no more than 25% by weight of chromium; wherein, the total content of molybdenum, boron, nickel, and chromium in the thermal spraying powder is no less than 95% by weight; and, the primary crystal phase of the thermal spraying powder is multi-element ceramics containing at least one of nickel and chromium along with molybdenum and boron.

11. The thermal spraying powder according to claim 10, wherein in an X-ray diffraction pattern of the thermal spraying powder, there is a plurality of peaks originating from the multi-element ceramics with one of the peaks having a maximum intensity that is no less than twice that of other peaks originating in chemical species other than the multi-element ceramics.

12. The thermal spraying powder according to claim 10, wherein the content of the molybdenum in the thermal spraying powder is no less than 40% by weight and no more than 50% by weight.

13. The thermal spraying powder according to claim 10, wherein the content of the boron in the thermal spraying powder is no less than 6% by weight and no more than 10% by weight.

14. The thermal spraying powder according to claim 10, wherein the content of the nickel in the thermal spraying powder is no less than 25% by weight and no more than 35% by weight.

15. The thermal spraying powder according to claim 10, wherein the content of the chromium in the thermal spraying powder is no less than 14% by weight and no more than 18% by weight.

16. The thermal spraying powder according to claim 10, wherein the thermal spraying powder is composed of particles, and the particles have mechanical strength of no less than 50 MPa and no more than 600 MPa.

17. The thermal spraying powder according to claim 16, wherein the particles have mechanical strength of no less than 150 MPa and no more than 400 MPa.

18. The thermal spraying powder according to claim 10, wherein the thermal spraying powder is used in applications for forming a thermal sprayed coating by high-velocity flame spraying.

* * * * *